United States Patent [19]

Peters

[11] 4,025,961

[45] May 31, 1977

[54] CAPE FOR DEALING WITH THE HAIR

[76] Inventor: Rita Moore Peters, 952 Walnut St., Allentown, Pa. 18102

[22] Filed: Dec. 12, 1975

[21] Appl. No.: 640,039

[52] U.S. Cl. ..... 2/88

[51] Int. Cl.[2] ..... A41D 3/08

[58] Field of Search ..... 2/50, 52, 49 R, 91, 2/88, 92, 119, 174, 207

[56] References Cited

UNITED STATES PATENTS

| | | | |
|---|---|---|---|
| 2,246,035 | 6/1941 | Elliot | 2/50 |
| 2,857,599 | 10/1958 | Wallace | 2/49 R |

*Primary Examiner*—Werner H. Schroeder
*Assistant Examiner*—Doris L. Troutman
*Attorney, Agent, or Firm*—Jackson, Jackson & Chovanes

[57] ABSTRACT

A cape especially valuable for dealing with the hair made preferably of turkish toweling or in a particular case plastic, but suitably of various other materials, consisting of a shoulder-embracing portion, a slot for the head, two tongues surrounding the neck, there being curving lobes at the base of the tongues for overlapping on the chest or behind the shoulders. Special surface-type fasteners sit on the tongues near the end, and cooperating contact surface-type fastening places are near the top of the lobes. There are preferably also loops near the tops of the lobes which can surround the other tongues.

6 Claims, 8 Drawing Figures

CAPE FOR DEALING WITH THE HAIR

DESCRIPTION OF THE INVENTION

The invention comprises a cape especially useful for dealing with the hair, used by hairdressers, barbers, dentists and any person who wishes to cut, adjust or arrange the hair, or work on the mouth. It can also be used for street or beach wear.

The cape consists preferably of turkish toweling material, but may be a suitable other cloth or plastic or paper, or similar sheet material, or even fur. Plastic is especially appropriate where the chief purpose is to protect a person or his clothing from getting wet while the hair is being washed, or otherwise worked on. The cape has a shoulder-embracing portion, a slot for the head and two tongues surrounding the neck, there being curving lobes at the base of the tongues for extending over the chest or behind the shoulders to preferably overlap over the closest portion of the other such lobe.

In the preferred form the cape has some form of surface-type fasteners on the tongues near their tops and cooperating fastening places are at the top of the respective other lobes.

There are also loops near the tops of the lobes which will surround the other tongue. This may be used in place of the special fastening places in any case where it may be preferred or necessary. It is especially useful as giving a further adjustment of the cape as a whole to make sure of the ultimate in possible exactness of fit for example.

DRAWINGS

The drawings are exemplary and variations may be made within the spirit of the invention.

PRIOR ART

Figure 1:
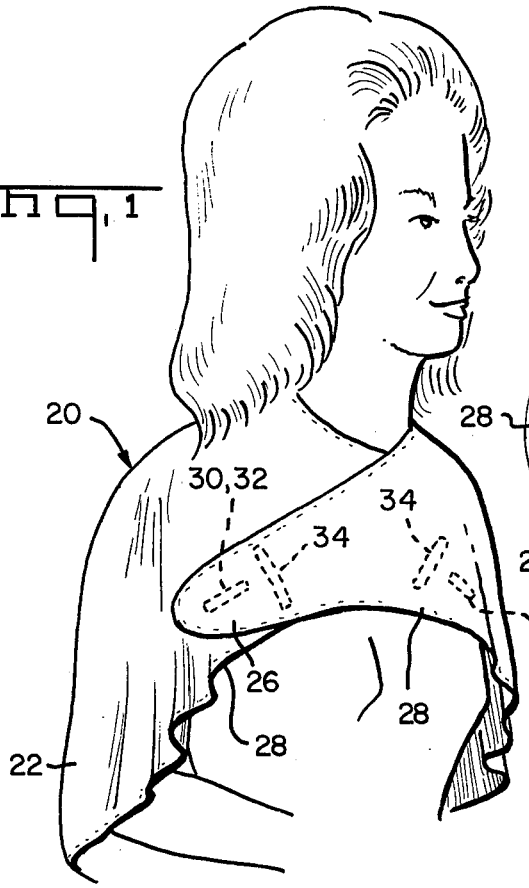
FIG. 1 is more or less of a three-quarter front elevational view of a particular embodiment of the cape of the invention in use on a person.

In a beauty salon, in the actual prior practice as known to me, the hairdresser first puts a paper strip around the neck of the client or drapes a towel around the neck. Then she drapes a plastic cape. The hair is washed and the excess water is wiped off with a towel. The towel is then draped around the neck so that any water dripping from the head is caught by the towel. The towel is used also to catch lotion and the like which might be used. This procedure is uncomfortable for the patron and bulky for the hairdresser.

THE PRESENT INVENTION

In the present improvement a contoured towel will fit under a contoured cape so that the hair can be dried by the towel and the towel can drape comfortably on the shoulders. The towel or cape is reversible and the curving lobes may be drawn together either in front of the shoulders or behind the shoulders, depending for example where protection from wetting or the like is most needed, or where fastening is most convenient or as the desired appearance which the garment is intended to present dictates.

FABRICS

In the preferred embodiment the cape is made preferably from turkish toweling or, as a less desirable option, some other form of terry cloth, since they are absorbent and may be relied on to keep the person dry. The cape may also be made of nylon. Less desirably, the cape may be made from linen such as the cloth from which dishtowels are made. The cape can also be made of paper, and in that case can if desired by disposable.

Another material which is especially appropriate if the particular cape is being used in a hairdressing operation especially for the purpose of keeping the person or his or her clothing from getting wet is plastic such as rainwear cloth. For example, two such capes can be used at once, one on top of each other, with one of absorbent material, and the other, for example the one on top, being of plastic.

Other suitable materials may be used. For example, where it is intended mainly for street wear, fur may be used.

DETAILED DESCRIPTION

The contoured cape is reversible, and the curving lobes may come together either in front of the shoulders or behind the shoulders. The cape may also be provided in long or short versions, for example on the one hand to ankles or knees, and on the other hand ordinary cape length or short.

In case two capes are used, the outer one of plastic may also be contoured.

The cape 20 has a shoulder-surrounding portion 22, a slit for the head, tongues 26 on either side of the neck, and curving lobes 28 on the end of the shoulder-surrounding portion, which lobes are overlapped in front of the shoulders.

The cape may be drawn together behind the shoulders instead of in front of the shoulders.

The cape has a dual purpose since it is both to surround the body and protect it from any drippings and the like, and also if suitably absorbent, can be used separately as a towel.

In the cape, special surface-type fasteners 30 are secured at the ends of the tongues, which meet with respective cooperating fastening places 32 on the top of the opposite lobe, the cooperating surface-type fasteners and fastening places being so positioned as to be on opposite faces of the cape, so that one will lie on top of and meeting the other when the cape is draped around the shoulders.

Depending on what is desired in view of convenience and expense, the cooperating surface-type fasteners and fastening places may involve some well known adhesive such as glue or contact fasteners such as the pressure-sensitive type, for example.

Figure 6:
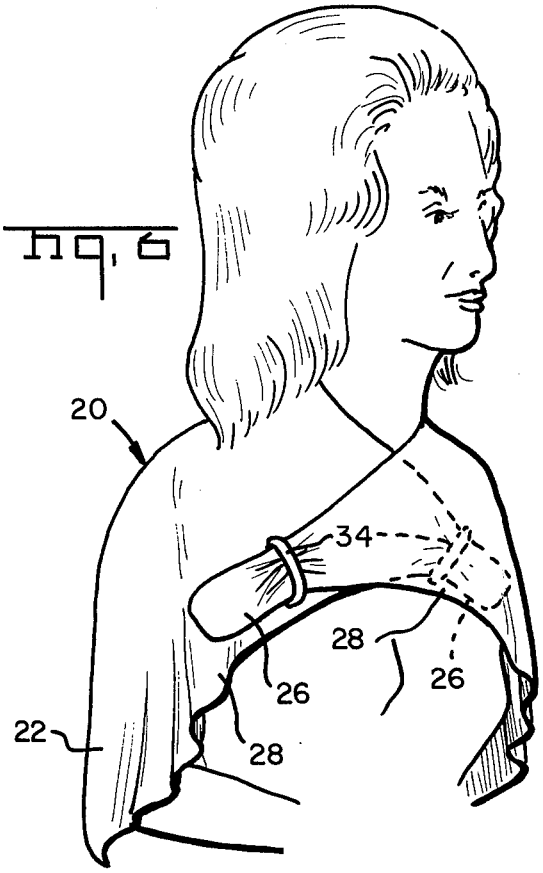
FIG. 6 is a view like FIG. 1 showing the cape in use, but using the loops instead of the special surface-type fasteners.
Figure 7:
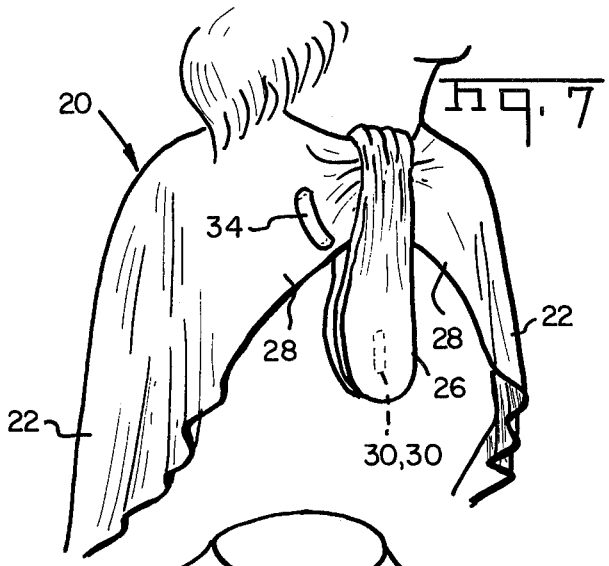
FIG. 7 is another view like FIGS. 1 and 6, but showing the cape in use fastened still another way.
Figure 8:
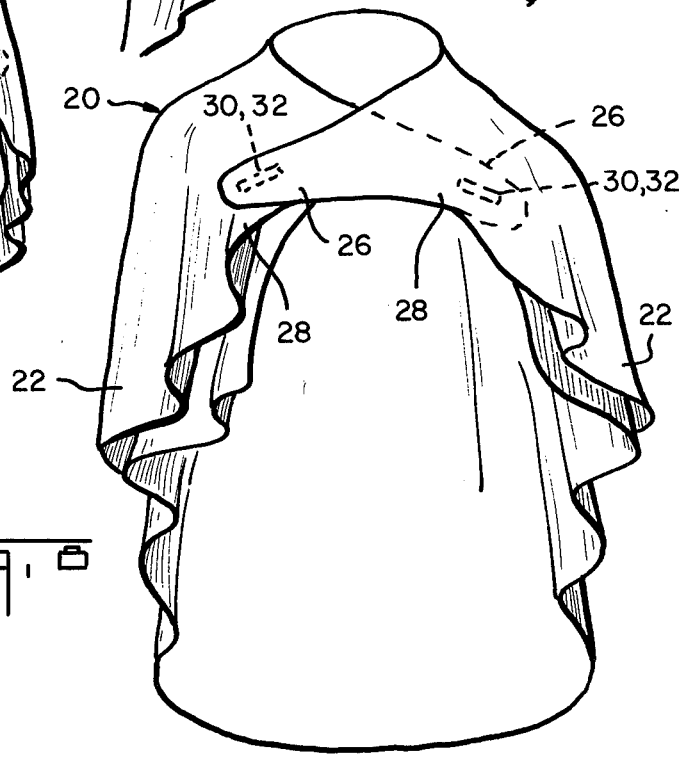
FIG. 8 is a front elevational view of the same embodiment of the invention fastened the same way as in FIG. 1 and hanging the same way as in FIG. 1, but without any person being shown covered by it. This enables the back of the cape in this position to be seen from in front.

The particular structure involved provides an especially contoured and streamlined overall structure especially adapted to fit the wearer. The wearer is enabled to take especially good advantage of this by the specifics of the device. The wearer can fasten the cape either with the longer portion in back or in front, to suit the situation, and he can do this fastening by means of the surface-type fasteners 30 and their cooperating fastening places 32 in a direct cross-body type of way, as shown in FIG. 1, or by means of the loops 34 being brought to surround the tongues 26, in a direct cross-body cooperation, as shown in FIG. 6, or by a means utilizing the surface-type fasteners in a special way, as shown in FIG. 7. As will be seen, in this particular form, the tongues cross each other in front and then one is brought from behind the other to hang down in front of the rest of the front part of the cape, while the other tongue is brought to a position where it will hang down behind the other tongue, and the two tongues are united toward their end, by means of their special surface-type fasteners 30—30.

Thus the cape by its construction affords considerable variety of positioning to make it even more certain than otherwise that unusually good fit will be secured, by enabling use of whichever means of fastening best conduces to this. This also gives a potentiality of variety of appearance which also may be valuable. Furthermore, it means that if the surface-type fastener is impaired or destroyed, as in washing for example, the utility of the cape is not destroyed, since another means of fastening can be used.

For hanging up, the cape has a loop 36.

As indicated for example in FIG. 1, the cape can have stitching along the edge, Merrow stitching or in other words, stitching of the type made by the so-called Merrow machine, being expecially suitable.

The particular cape or the like of the present invention will give an unusually perfect fit on all shapes or sizes of neck, and eliminate dripping on the necks of the people on whom it is used.

Figure 2:
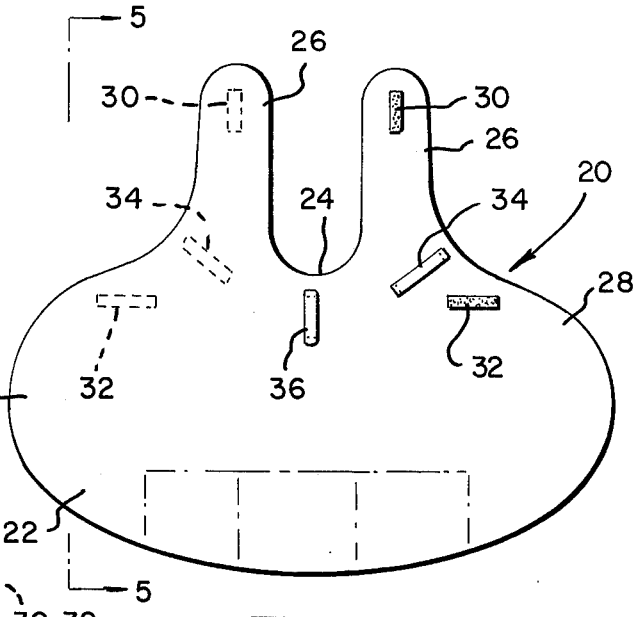
FIG. 2 is a plan view of the same embodiment of a cape of the invention as it would appear when lying spread out on a flat surface when not in use, with pockets which may, if desired, be omitted shown in dotted lines.
Figure 3:
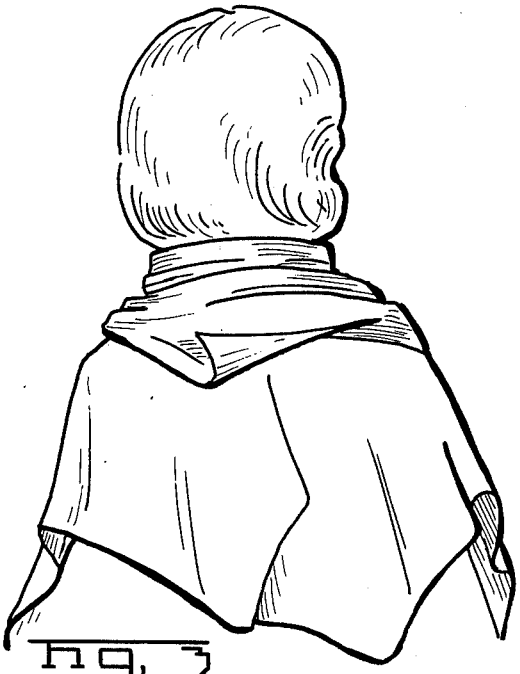
Fig. 3 PRIOR ART
FIGS. 3 and 4 are respectively views of a person from the back and in profile, using items which are in use in the prior art.
Figure 4:
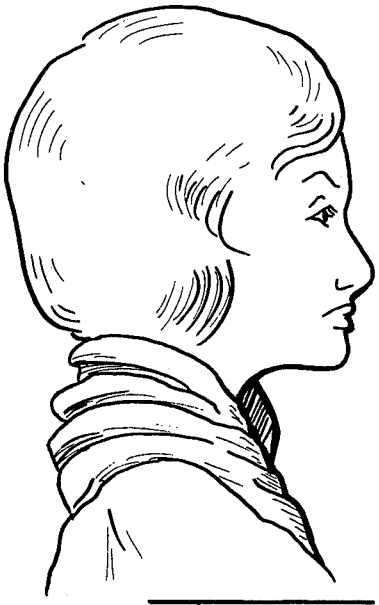
Fig. 4 PRIOR ART
Figure 5:
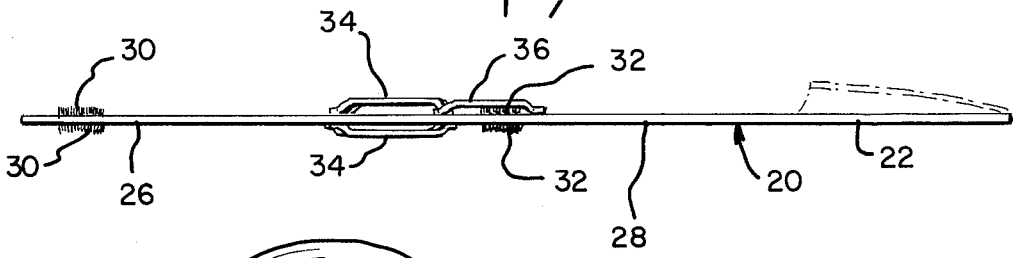
FIG. 5 is a side elevational view of what is shown in FIG. 2.

There may be an advantage in using the cape of the invention with pockets around the bottom rim, and this is a special possible feature which may be advantageous for storage of clips for the hair, both before and after use. Such pockets, located on the outside of the cape, with curved bottoms and flat tops, are shown in FIGS. 2 and 5, in dotted lines.

Where the cape is of paper, the fact that it fits so well to the neck is especially important, because paper can be expecially deficient in this respect and very likely to stand out in an inconvenient way if this is not true.

Where what is used is a pressure-sensitive adhesive tape, this is especially suitable where the material used for the cape was of paper. In place of a single surface of pressure-sensitive adhesive, there could be used a somewhat solid bit of pressure-sensitive adhesive which made contact with and stuck to both of the portions of the cape which are intended to be adhered to one another. Such a separate piece could be used where some adhesive material like glue was to be used also, the piece being in the form of a flexible circular ring of tape like a small garter with adhesive material like glue on the outer annular surface and the piece could then be flattened out by folding at opposite places on the edge and have the two opposite faces caused to adhere to the respective surfaces of the cape intended to be held together by surface-type fasteners and cooperating fastening surfaces.

In view of my invention and disclosure, variations and modifications to meet individual whim or particular need will doubtless become evident to others skilled in the art to obtain all or part of the benefits of my invention without copying the structure shown, and I, therefore, claim all such insofar as they fall within the reasonable spirit and scope of my claims.

Having thus described my invention what I claim as new and desire to secure by Letters Patent is:

1. A setup for protection from materials used in work upon the hair, comprising an outer and an inner cape, each extending outward from contact with the lower neck to cover at least the entire shoulders and the portions of chest and back between the shoulders, the outer cape being of plastic and the inner cape of Turkish toweling-type material but the two capes being otherwise similar to each other, each cape having a body and two tongues each of which tongues extends from the body to a far end respectively and the two tongues having a space between them for the neck of the person, each cape having lobes extending outward from the base of the respective tongues and the lobes having their outer edges extending from the point of junction with the base of the respective tongues curvingly in a direction outwardly and away from the far ends of the tongues, there being on each cape at least two cooperating contact fastener pairs each of which includes the one cooperating contact element on the face of a different tongue near the far end of that tongue and the second cooperating contact element on a cooperating face of the lobe further from that tongue near the base of the other tongue, and there being loops located on the respective lobes near the base of the respective tongues and extending out from the same face of the respective lobes as the second cooperating element is respectively located on, the capes being adapted to be held together around a person's shoulders in any one of three alternative different ways.

2. A setup of claim 1, in which pockets are located on the outside of the capes along the bottom edge of the base of the cape.

3. A cape for use upon the shoulders comprising a body extending outward from contact with the lower neck to cover at least the entire shoulders and the portions of the chest and back between the shoulders, two tongues each extending more or less parallel to each other from the body to a far end and having space between them adapted to have the neck with them in contact with it, the body including lobes extending outwardly from the base of the respective tongues curvingly in a direction outwardly and away from the far ends of the tongues, there being at least two cooperating contact fastener pairs each of which includes the one cooperating contact element on the face of the different tongue near the far end of that tongue and a second cooperating contact element on a cooperating face of the lobe further from that tongue near the base of the other tongue, and there being loops located on the respective lobes near the base of the respective tongues and extending out from the same face of the respective lobes as the second cooperating element is respectively located on, the cape being adapted to be held together around a person's shoulders in any one of three alternative different ways.

4. A cape of claim 3, in which pockets are located on the outside of the cape along the bottom edge of the back of the cape.

5. A cape for use on the shoulders which when in use comprises a body which extends from contact with the lower part of the neck to cover the entire shoulders, two tongues extending in substantially parallel position from one side of the body to a far end and spaced from each other to form an open slot for the neck with them in contact with the lower part of the neck, and two lobes forming part of the body and each extending outwardly from the base of a different tongue and having their edges curving out and back away from the far end of that tongue, for partly overlapping on the chest or back, two separate contact fastener setups, each respectively adapted to apply between the far end of a different one of the tongues and the opposite lobe near the base of the opposite tongue, and two fastening loops on the cape near where tongue and lobe meet, one on the outside near one tongue and lobe the other on the inside near the other tongue and lobe, the contact fastener setups on the one hand and the loops on the other, each being capable in itself in cooperation with the cape, of holding the cape together around the upper part of the person.

6. A cape of claim 5, in which there are pockets on the outside of the body, along the bottom of the cape.

* * * * *